US006638108B2

(12) United States Patent
Tachi

(10) Patent No.: US 6,638,108 B2
(45) Date of Patent: Oct. 28, 2003

(54) CONNECTOR WITH PLURAL HOUSINGS ACCOMMODATED IN A CASING

(75) Inventor: Hideshi Tachi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/995,050

(22) Filed: Nov. 27, 2001

(65) Prior Publication Data

US 2002/0064994 A1 May 30, 2002

(30) Foreign Application Priority Data

Nov. 30, 2000 (JP) ..... 2000-364772

(51) Int. Cl.[7] ..... H01R 13/40

(52) U.S. Cl. ..... 439/595; 439/540.1; 439/587; 439/693; 439/695; 439/701

(58) Field of Search ..... 439/595, 592, 439/603, 701, 587, 589, 540.1, 695

(56) References Cited

U.S. PATENT DOCUMENTS 5,344,347 A 9/1994 Inoue et al.
5,525,077 A 6/1996 Badaroux
6,146,200 A * 11/2000 Ito et al. ..... 439/596
6,159,047 A * 12/2000 Tanaka ..... 439/595
6,302,735 B1 * 10/2001 Nishide et al. ..... 439/595
6,450,823 B1 * 9/2002 Ichio et al. ..... 439/275

FOREIGN PATENT DOCUMENTS

EP 0 895 312 2/1999
JP 2000-67989 12/2000

* cited by examiner

*Primary Examiner*—P. Austin Bradley
*Assistant Examiner*—Truc Nguyen
(74) *Attorney, Agent, or Firm*—Gerald E. Hespos; Anthony J. Casella

(57) ABSTRACT

A connector has an auxiliary housing (10) with cavities (11) and locks (14) cantilevered into the cavities (11). The locks (14) deform into deformation permitting spaces (S) during insertion of terminal fittings (12) into the cavities (11). The locks (14) resiliently return to an undeflected condition to engage locking holes (12*a*) in terminal fittings (12) after insertion to proper depth. Deformation restricting portions (58) are integrally provided in an accommodation recess (53) of a housing main body (50) for accommodating the auxiliary housing (10). The deformation restricting portions (58) enter the deformation permitting spaces (S) for the locks (14) as the auxiliary housing (10) is accommodated into the accommodation recess (53), thereby preventing the locks (14) from inadvertently undergoing an elastic deformation.

12 Claims, 5 Drawing Sheets

CONNECTOR WITH PLURAL HOUSINGS ACCOMMODATED IN A CASING

BACKGROUND OF THE INVENTION

1. Field of the Invention

The present invention relates to a connector.

2. Description of the Related Art

A known connector is disclosed in U.S. Pat. No. 5,344,347 and is illustrated in FIGS. 8 and 9 herein. The connector of FIGS. 8 and 9 includes a casing 1 into which a housing 2 can be inserted. The housing 2 is formed with cavities 3, and terminal fittings 4 are inserted into the cavities 3 before the housing 2 is mounted into the casing 1. Locks 5 are cantilevered from the bottom surfaces of the cavities 3 and are temporarily deformed by the terminal fittings 4. When the terminal fittings 4 are inserted to proper depth, the locks 5 are restored elastically to their original shape to engage and lock the terminal fittings 4.

The terminal fittings 4 could come out of the cavities if the locks 5 erroneously undergo an elastic deformation after the terminal fittings 5 are accommodated. Deformation-restricting members have been used to prevent inadvertent elastic deformation of the locks 5. For example, Japanese Unexamined Patent Publication No. 12-67989 shows a known deformation-restricting member that enters the deformation permitting spaces for the locks after the terminal fittings have been accommodated in the housing. The problem of inadvertent elastic deformation of the locks can be solved by the teaching of Japanese Unexamined Patent Publication No. 12-67989 to the connector shown in FIG. 8.

The deformation-restricting member of Japanese Unexamined Patent Publication No. 12-67989 is mounted first in a partial locking position in the housing. The terminal fittings then are inserted into the cavities and the deformation-restricting member is pushed to its full locking position. The housing then is placed into the casing. Thus, four cumbersome operations are required to assemble the connector, and assembling efficiency is poor.

In view of the above, an object of the present invention is to provide a connector that can be assembled with fewer operational steps.

SUMMARY OF THE INVENTION

The invention is directed to a connector with at least one housing formed with cavities into which terminal fittings are insertable. Locks are deformed temporarily and enter deformation-permitting spaces as the terminal fittings are inserted into the cavities. The locks are restored resiliently or elastically when the terminal fittings reach a proper depth and engage the terminal fittings. The assembly of the housing and the terminal fittings then can be inserted into a casing. The casing comprises at least one deformation-restricting portion that enters the deformation-permitting spaces for the locks as the housing is accommodated into the casing. Thus, deformation of the locks is restricted and the terminal fittings cannot be removed from the cavities.

The deformation-restricting portion is provided in the casing. As a result, the number of operation steps required to assemble the connector can be reduced as compared to a prior art connector which requires the deformation restricting portion to be mounted as a separate member in a partial locking position in the housing and then requires the deformation restricting portion to be pushed to a full locking position.

The deformation-restricting portion preferably is integral or unitary with the casing. Thus, the number of parts can be reduced as compared to the deformation-restricting portion that is mounted in the casing as a separate member, and the number of assembly steps can be reduced further.

A plurality of cavities preferably are arranged side by side in the housing and a plurality of deformation restricting portions are provided side by side in the casing to correspond to the deformation permitting spaces in the respective cavities. Thus adjacent deformation restricting portions are coupled, and the strength of the deformation restricting portions can be enhanced.

The side-by-side cavities preferably are arranged at two or more stages in the housing and the side-by-side deformation-restricting portions preferably are provided at stages in the casing to correspond to the deformation-permitting spaces in the cavities. Coupling portions preferably couple the stages of deformation-restricting portions to each other.

A receiving groove preferably is provided in the deformation-restricting portion. The receiving groove is configured to receive the corresponding lock and to restrict deformation of the lock towards the deformation permitting space and in widthwise directions of the lock. A base of the lock preferably can be received in the receiving groove so that upper and opposite side surfaces of the base contact the circumferential surfaces of the corresponding receiving groove.

A groove array may be formed in the front surface of the housing to separate a front part of the auxiliary housing into groups of several cavities. Ribs are provided in the casing and are insertable into corresponding grooves of the groove array. Thus, entrance of the ribs into the groove array facilitates the insertion operation of the housing into the casing. Preferably, the deformation restricting portions are provided integrally or unitarily on the ribs.

At least two housings preferably are assembled into one casing.

A resilient member may be fit to a portion of the housing and the terminal fittings may arranged therein to provide a watertight fit. The resilient member preferably is pressed against the housing and/or to the terminal fittings by a pressing member secured to the casing.

These and other objects, features and advantages of the present invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

A female connector in accordance with the invention has a three auxiliary housings 10 each of which has a plurality of female terminal fittings 12 inserted therein in an insertion direction ID, as shown in FIGS. 1–7. The auxiliary housings 10 are inserted in an inserting direction ID into a housing main body 50. The inserting direction ID is referred to as a forward direction in the following description.

Figure 1:
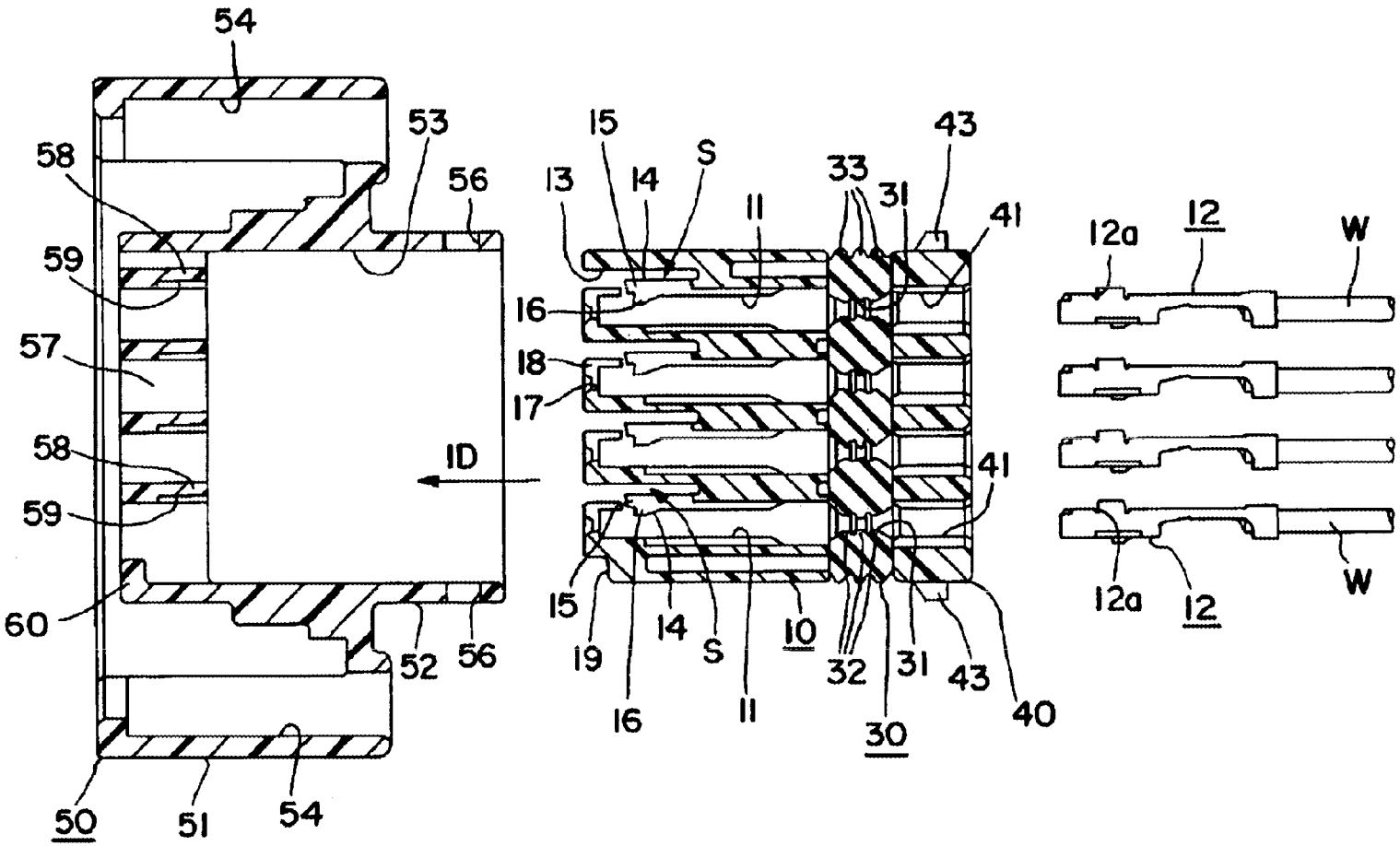
FIG. 1 is an exploded side view in section of a female connector according to one embodiment of the present invention.
Figure 2:
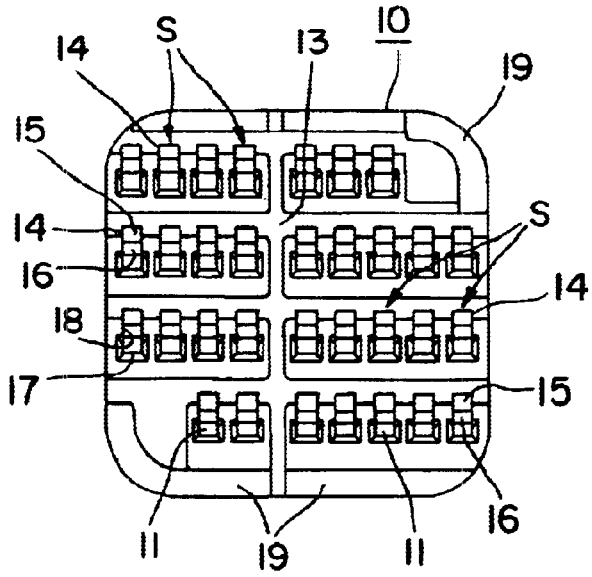
FIG. 2 is a front view of an auxiliary housing.

The female terminal fittings 12 are crimped into connection with ends of wires W and are inserted from behind into cavities 11 formed in the auxiliary housing 10, as shown in FIGS. 1 and 2. The cavities 11 are arranged in a widthwise direction at each of four stages. A groove array 13 is formed in the front surface of the auxiliary housing 10 to separate a front part of the auxiliary housing 10 into groups of several cavities 11. Specifically, the groove array 13 includes a groove that extends in height direction at a position slightly displaced from the widthwise center toward the left side and divides the cavities 11 into left and right cavities. The groove array also includes grooves that extend laterally and divide both the-left and right cavities into four stages. Thus, the cavities 11 are divided into 8 (2×4) blocks.

A lock 14 is cantilevered from the upper surface of each cavity 11. This lock 14 extends in forward and backward directions and has a base 15 including the upper surface of the cavity 11 and a locking section 16 projecting into the cavity 11 from the bottom surface of the base 15. The lock 14 deforms up about the base 15 away from the cavity 11 in response to pushing forces exerted on the locking section 16 by the female terminal fitting 12 as the female terminal fitting 12 is inserted into the cavity 11. The lock 14 then is restored elastically or resiliently substantially to its original shape and the locking section 16 enters a hole 12*a* in the female terminal fitting 12 to engage an edge of the hole 12*a* when the female terminal fitting 12 is inserted to proper depth. The groove array 13 extends to and includes a deformation permitting space S adjacent the lock 14 for permitting the elastic deformation of the lock 14.

A through hole 17 is formed in the front wall of each cavity 11 so that a mating male terminal fitting (not shown) can be inserted from front. Additionally, a mold removing hole 18 is formed above the through hole 17 and communicates with the groove array 13 to remove a mold when the lock 14 is molded. Furthermore, recesses 19 are formed at the bottom of the front end of each auxiliary housing 10 and at the upper right corner thereof in FIG. 2.

Figure 3:
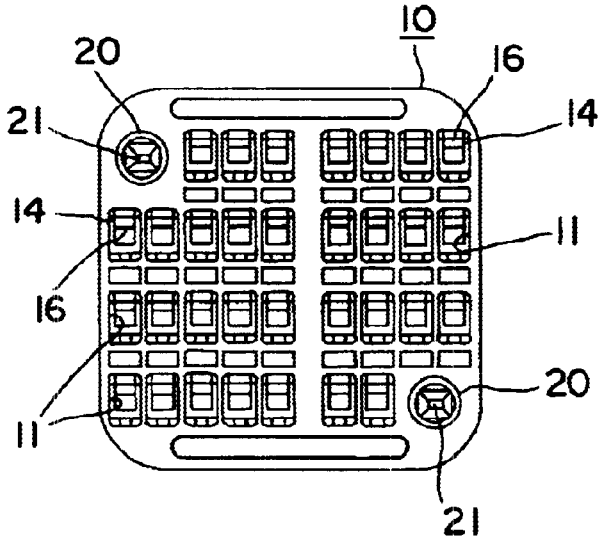
FIG. 3 is a rear view of the auxiliary housing.
Figure 4:
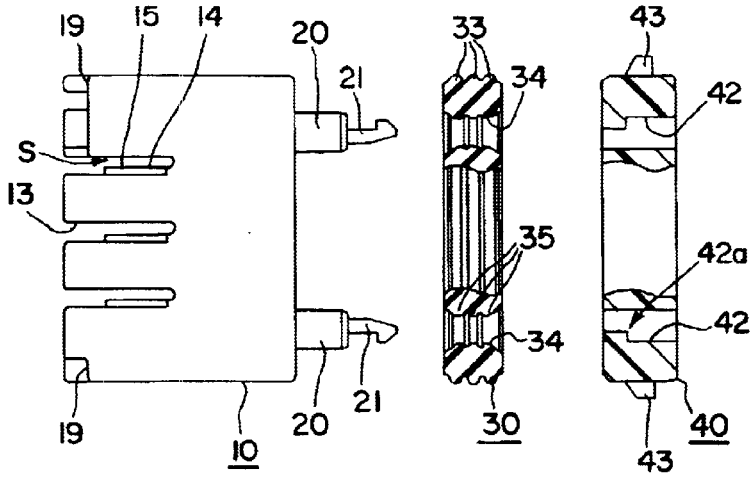
FIG. 4 is an exploded side view partly in section showing the auxiliary housing, a rubber plug and a pressing member.

Two cylindrical holding projections 20 extend back from the rear end surface of each auxiliary housing 10, as shown in FIGS. 3 and 4, and holding arms 21 with a hook-shaped leading ends project further back from the rear surfaces of the holding projections 20. The holding projections 20 and the holding arms 21 are provided at diagonal positions at the upper left corner and the lower right corner of the rear end surface of the auxiliary housing 10, in FIG. 3. A rubber plug 30 and a holding or pressing member 40 to be described in detail later are mounted successively on the rear surface of the auxiliary housing 10. The rubber plug 30 and the pressing member 40 are held onto the auxiliary housing 10 by the holding projections 20 and the holding arms 21.

The rubber plug 30 is a substantially flat plate that covers substantially the entire rear surface of the auxiliary housing 10. Insertion holes 31 are formed in alignment with the respective cavities 11 of the auxiliary housing 10 and are dimensioned for inserting the female terminal fittings 12 therethrough. Circumferentially extending inner lips 32 are provided one after another on the inner circumferential surface of each insertion hole 31 and are dimensioned for close contact with a wire W connected with the female terminal fitting 12 to hold the wire W watertight. Additionally, circumferentially extending outer lips 33 are provided one after another on the outer circumferential surface of the plug 30. The outer lips 33 closely contact the housing main body 50 as the auxiliary housing 10 is accommodated in the housing main body 50 to hold the auxiliary housing 10 and the housing main body 50 watertight (see FIG. 7). The rubber plug 30 also is formed with a pair of insertion holes 34 through which the holding projections 20 of the auxiliary housing 10 are insertable. Inner lips 35 similar to the inner lips 32 are formed on the inner circumferential surfaces of the insertion holes 34 for closely contacting the outer circumferential surfaces of the holding projections 20.

The pressing member 40 is a substantially flat plate and is mounted to cover substantially the entire rear surface of the rubber plug 30. Insertion holes 41 are formed at positions on the pressing member 40 aligned with the cavities 11 of the auxiliary housing 10 and the insertion holes 31 of the rubber plug 30, and are dimensioned for inserting the female terminal fittings 12 therethrough. The pressing member 40 also is formed with stepped holding holes 42 at positions aligned with the insertion holes 34 of the rubber plug 30. As the pressing member 40 is mounted on the auxiliary housing 10, the hooked portions of the holding arms 21 are engaged with the stepped portions 42*a* of the holding holes 42. Thus, the rubber plug 30 and the pressing member 40 are assembled integrally with the auxiliary housing 10. The rubber plug 30 is compressed slightly in the assembling direction between the pressing member 40 and the auxiliary housing 10. Two locking projections 43 project down from the bottom surface of the pressing member 40 and two other locking projections 43 project up from the upper surface thereof. The locking projections 43 are engageable with locking holes 56 formed in the housing main body 50 as the auxiliary housing 10 is mounted into the housing main body 50, so that the auxiliary housing 10, the rubber plug 30 and the pressing member 40 can be locked in the housing main body 50 (see FIG. 7).

Figure 5:
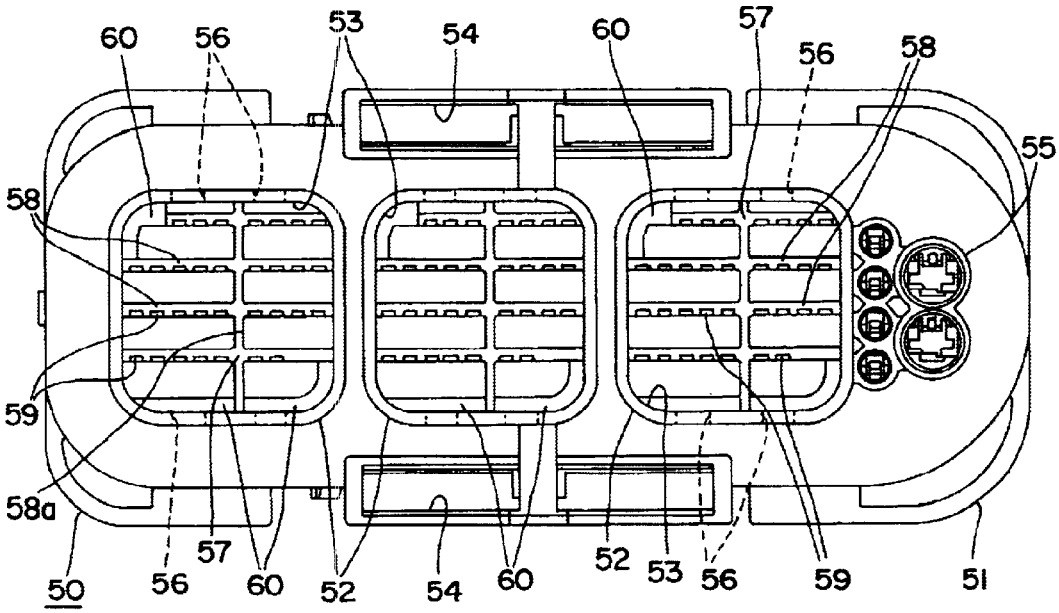
FIG. 5 is a rear view of a housing main body.

As shown in FIGS. 1 and 5, the housing main body 50 has three inner tubular bodies 52 arranged substantially side by side in the widthwise direction and are coupled inside an outer tubular body 51. The auxiliary housings 10 are accommodated recesses 53 in the respective inner tubular bodies 52. An unillustrated mating male connector is fittable between the outer tubular body 51 and the inner tubular bodies 52 from front. The outer tubular body 51 substantially surrounds the inner tubular bodies 52, and inwardly extending portions at the rear end of the outer tubular body 51 are coupled to the inner tubular bodies 52. Lever chambers 54 are provided at central upper and lower sides of the outer tubular body 51 for accommodating an unillustrated lever of a mating connector, and terminal chambers 55 are provided adjacent to and at the right side of the rightmost inner tubular body 52 shown in FIG. 5 for accommodating a plurality of two kinds of terminal fittings differing in size.

Each inner tubular body 52 is substantially in the form of a rectangular tube, and its rear part projects more backward than the outer tubular body 51. The auxiliary housing 10 assembled with the rubber plug 30 and the pressing member 40 is insertable into each accommodation recess 53 from behind. Locking holes 56 penetrate through the upper and bottom walls of the rear part of the accommodating recess 53 and are engageable with the locking projections 43 of the pressing members 40. A lattice-shaped rib 57 is provided at the front of the accommodation recess 53, and can be fit into the groove array 13 as the auxiliary housing 10 is accommodated into the accommodation recess 53. Rear ends of the rib 57 project towards the accommodation recess 53 and extend in the widthwise direction to define deformation restricting portions 58 that can enter the deformation permitting spaces S of the groove array 13. Thus, the housing main body 50 is provided integrally or unitarily with the deformation restricting portions 58. A plurality of deformation restricting portions 58 are provided substantially side by side in widthwise direction at positions corresponding to the respective deformation permitting spaces S of the auxiliary housings 10. Hence, adjacent deformation restricting portions 58 are coupled to each other and groups of the deformation restricting portions 58 that are coupled in the widthwise direction also are coupled to each other in height direction by means of ribs 57 acting as coupling portions 58*a*. Receiving grooves 59 are formed below the deformation restricting portions 58 of the rib 57 for accommodating the bases 15 of the locking portions 14. The width of the receiving grooves 59 is substantially equal to that of the bases 15 of the locking portions 14. Further, projections 60 extend from the rib 57 at the upper and lower front of each accommodation recess 53 for insertion in the recesses 19 of the auxiliary housing 10.

When the auxiliary housing 10 is accommodated into the accommodation recess 53, the locking projections 43 of the pressing member 40 engage the locking holes 56 and the projections 60 fit into the recesses 19 of the auxiliary housing 10. Thus, the auxiliary housing 10, the rubber plug 30 and the pressing member 40 are held securely, and will not move in forward and backward or assembling directions. The deformation restricting portions 58 at the rear end of the rib 57 enter the deformation permitting spaces S for the locks 14 to restrict the elastic deformation of the locks 14 (see FIG. 7).

The rubber plug 30 and the pressing member 40 are mounted successively on the rear of the auxiliary housing 10, as shown in FIG. 1. At this stage, the rubber plug 30 and the pressing member 40 are held on the auxiliary housing 10 by the engagement of the holding arms 21 of the auxiliary housing 10 with the steps 42*a* inside the holding holes 42 of the pressing member 40.

Figure 6:
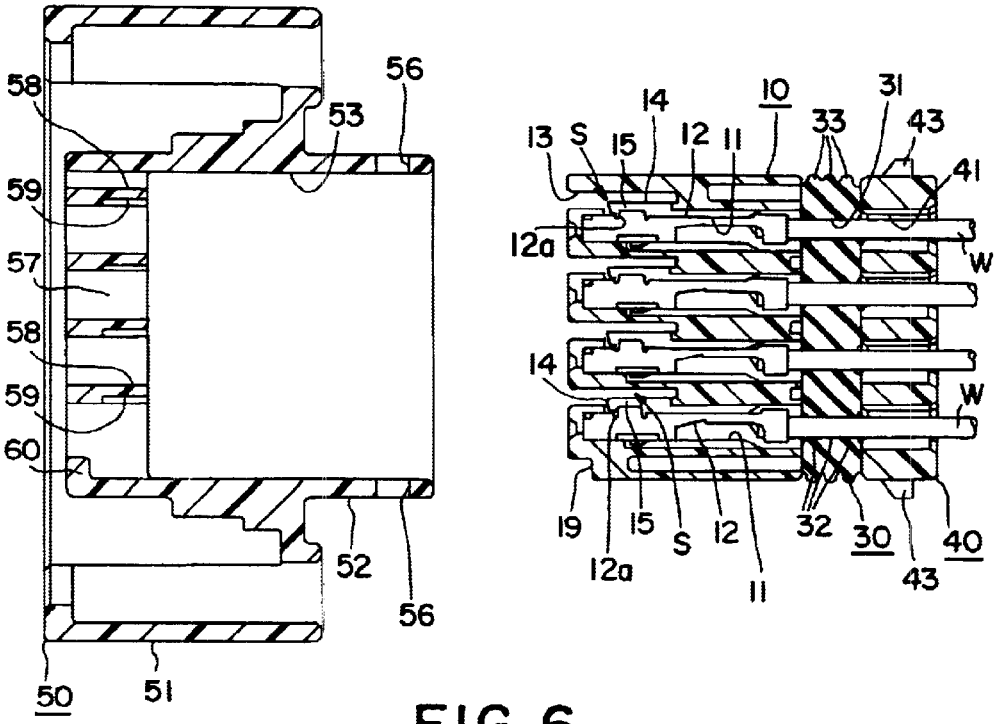
FIG. 6 is a side view in section showing a state where terminal fittings are accommodated in the auxiliary housing.

The female terminal fittings 12 then are inserted into the respective cavities 11 of the auxiliary housing 10 from behind. Each female terminal fitting 12 enters the corresponding cavity 11 of the auxiliary housing 10 after passing through the respective insertion holes 31, 41 of the pressing member 40 and the rubber plug 30. The female terminal fitting 12 pushes the locking section 16 of the lock 14 from behind, and the base 15 thereof is deformed into the deformation permitting space S. When the female terminal fitting 12 is inserted to proper depth in the cavity 11, the base 15 of the lock 14 is restored elastically or resiliently substantially to its original shape and the locking section 16 of the lock 14 enters the locking hole 12*a* of the female terminal fitting to engage the edge of the locking hole 12*a*, as shown in FIG. 6. In this way, the female terminal fitting 12 is held in the cavity 11. Further, the inner lips 32 of the rubber plug 30 are brought into close contact with the outer circumferential surface of the wire W, thereby holding the wire W watertight.

Figure 7:
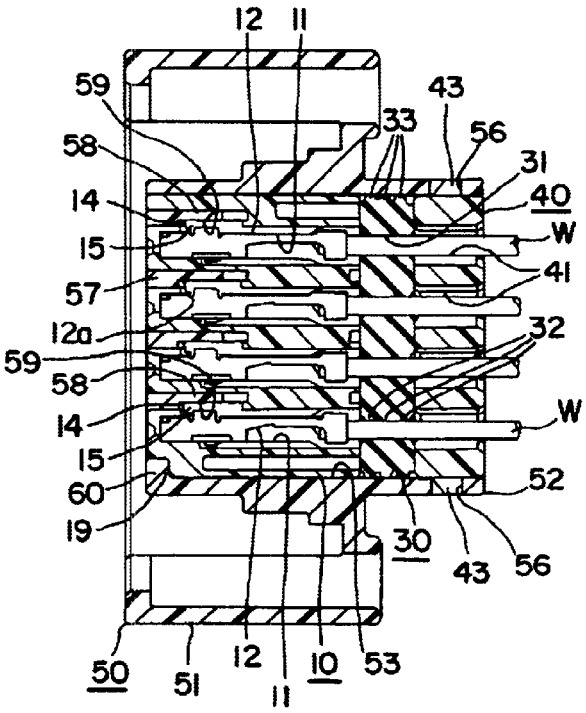
FIG. 7 is a side view in section showing a state where the auxiliary housing is accommodated into a recess of the housing main body.
Figure 8:
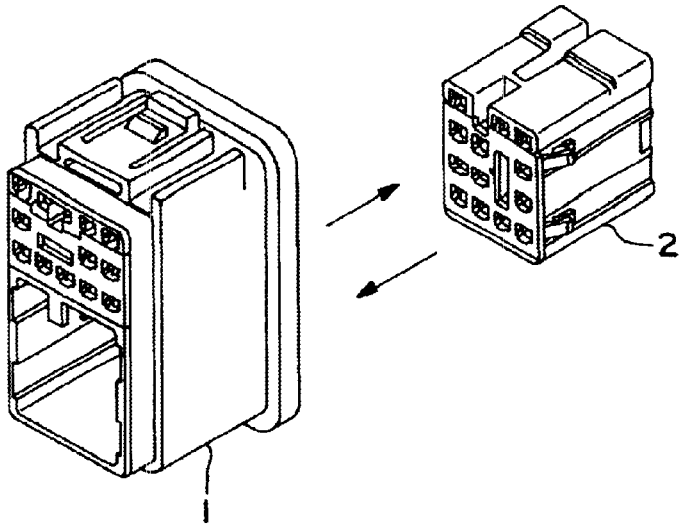
FIG. 8 PRIOR ART
FIG. 8 is a perspective view of a prior art connector.
Figure 9:
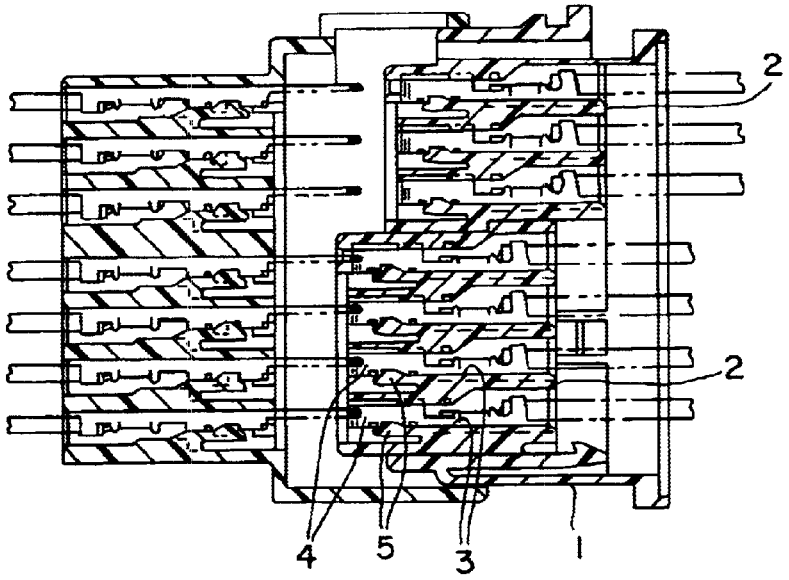
FIG. 9 PRIOR ART
FIG. 9 is a side view in section of the prior art connector.

The auxiliary housing 10 is inserted into the accommodation recess 53 of the housing main body 50 after the female terminal fittings 12 are accommodated in all the cavities 11. Insertion of the auxiliary housing 10, the rubber plug 30 and the pressing member 40 into the accommodation recess 53 of the housing main body 50 from behind is guided by the entrance of the rib 57 into the groove array 13 of the auxiliary housing 10. Then, the deformation restricting portions 58 at the rear end of the rib 57 enter the deformation permitting spaces S behind the groove array 13 and the bases 15 of the locks 14 enter the receiving grooves 59 below the deformation restricting portions 58. In other words, the bases 15 of the locks 14 are surrounded by the circumferential surfaces of the receiving grooves 59 at the rear end of the rib 57. When the auxiliary housing 10 is inserted to proper depth in the accommodation recess 53, the rib 57 reaches the bottom of the groove array 13, the projections 60 are fit into the recesses 19, and the locking projections 43 of the pressing member 40 are engaged with the locking holes 56 as shown in FIG. 7. In this way, the auxiliary housing 10, the rubber plug 30 and the pressing member 40 are held in the housing main body 50 so as not to loosely move in forward and backward or assembling directions. The deformation restricting portions 58 are located in the deformation permitting spaces S above the locking portions 14 in this assembled state. Thus, inadvertent elastic deformation of the locking portions 14 is prevented, and the female terminal fittings 12 will not come out of the auxiliary housing 10. Further, the bases 15 of the locks 14 are accommodated in the receiving grooves 59 of the rib 57 and the upper and opposite side surfaces of the bases 15 are in contact with or near the circumferential surfaces of the receiving grooves 59. Thus, both upward and lateral displacements of the locks 14 are prevented. At this stage, the outer lips 33 of the rubber plug 30 are in close contact with the inner circumferential surface of the accommodation recess 53 to hold the auxiliary housing 10 and the housing main body 50 watertight. Further, the rear end surface of the pressing member 40 and that of the inner tubular body 52 are substantially flush with each other. The female connector is assembled by accommodating the respective auxiliary housings 10 into the three accommodation recesses 53 of the housing main body 50 as described above.

As described above, the housing main body 50 is provided with the deformation restricting portions 58. Hence, the number of steps to assemble the connector can be reduced as compared to, for example, a case where the deformation restricting portions are separate members assembled into the auxiliary housings, thereby necessitating the mounting of deformation restricting portions in a partial locking position and an operation of pushing them to a full locking position after the terminal fittings are accommodated. As a result, assembling operability can be improved.

The deformation restricting portions 58 are formed integrally or unitarily with the housing main body 50. Thus, the number of parts and the number of operation steps can be reduced as compared to, for example, a case where the deformation restricting portions are assembled into the housing main body. This leads to a further reduction of production costs.

Side-by-side deformation restricting portions 58 arranged in widthwise direction are coupled to each other. Therefore, their strength can be enhanced. Furthermore, groups of the deformation restricting portions 59 that are coupled in widthwise direction also are coupled in height direction which is normal to widthwise direction, and their strength can be further enhanced.

Three auxiliary housings 10 are accommodated and the deformation restricting portions 58 are provided at the positions corresponding to the deformation permitting spaces S of the respective auxiliary housings 10 in the housing main body 50. Thus, the number of parts and the number of operation steps can be reduced as compared to a case where separate deformation restricting portions 58 are mounted in the respective auxiliary housings 10.

The invention is not limited to the above described and illustrated embodiment. For example, the following embodiments also are embraced by the technical scope of the present invention as defined in the claims. Beside the following embodiments, various changes can be made without departing from the scope and spirit of the present invention as defined in the claims.

Although the deformation restricting portions formed integrally or unitarily with the housing main body in the foregoing embodiment, they may be formed separately from the housing main body and integrally assembled into the housing main body. Even with such a construction, the number of operation steps can be reduced as compared to a case where the deformation restricting portions are assembled into the auxiliary housings, thereby necessitating an operation of mounting the deformation restricting portions in a partial locking position and then pushing them to a full locking position after the terminal fittings are accommodated.

Although three auxiliary housings are accommodated into the housing main body in the foregoing embodiment, the present invention is also applicable to a case where one, two, four or more auxiliary housings are accommodated into the housing main body.

Although adjacent deformation restricting portions are coupled to each other in the foregoing embodiment, the present invention is also applicable to deformation restricting portions that are separated from.

The present invention is applicable to, for example, panel mount-type connectors in addition to the connector illustrated herein.

The present invention is also applicable to male connectors for accommodating male terminal fittings.

What is claimed is:

1. A connector, comprising;

a plurality of separate housings, each said housing having opposite front and rear ends and being formed with a plurality cavities, extending between the front and rear ends, locks cantilevered forwardly into the respective cavities, each said lock being resiliently deflectable into a deformation permitting space open at the front end in the respective housing, a plurality of terminal fittings disposed respectively in the cavities of each of said separate housings and being locked in the respective cavities by the lock in the respective cavity, and a single casing having a main body and a plurality of inner tubular bodies, each said inner tubular body having opposite front and rear ends and an accommodation recess extending between the ends, each of the accommodation recesses being configured for receiving one of said separate housings such that the front end of the respective housing is in proximity to the front end of the inner tubular body and such that the rear end of the respective housing is in proximity to the rear end of the corresponding inner tubular body, the casing further comprising deformation restricting portions extending rearwardly from the front end of each said inner tubular body to a location between the front and rear ends of the inner tubular body, the deformation restricting portions extending into the deformation permitting spaces for restricting the deformation of the locks.

2. The connector of claim 1, wherein the deformation restricting portions are integrally or unitarily formed with the casing.

3. The connector of claim 1, wherein a plurality of the cavities are arranged substantially side by side in the housing and wherein the deformation restricting portions are provided substantially side by side in the casing to correspond to the deformation permitting spaces in the respective cavities, wherein adjacent ones of the plurality of deformation restricting portions are coupled to each other.

4. The connector of claim 1, wherein each said deformation restricting portion is provided with a receiving groove for receiving the corresponding lock to restrict a deformation of the lock towards the deformation permitting space and in widthwise directions of the lock.

5. The connector of claim 1, wherein a rectangular groove array is formed in a front surface of each said housing to separate a front part of the housing into groups of several cavities, the deformation restricting portions including a rectangular array of ribs being provided in the casing and being insertable into corresponding portions of the groove array.

6. The connector of claim 1, further comprising a plurality of rubber plugs mounted respectively to the rear end of the housing and configured for sealed engagement with the accommodating recess of the respective inner tubular body.

7. The connector of claim 4, wherein a base of the lock can be received in the receiving groove so that upper and opposite side surfaces of the base are in contact with the circumferential surfaces of the corresponding receiving groove.

8. The connector of claim 5, wherein the deformation restricting portions are unitarily provided on the ribs.

9. The connector of claim 5, wherein the deformation permitting spaces of each said housing are formed in part of said rectangular groove array.

10. The connector of claim 9, wherein the rectangular groove array extends continuously across the front end of each said housing in at least one direction.

11. The connector of claim 6, further comprising a plurality of holders mounted respectively to the rear ends of the respective housings for holding the respective rubber plug in a specified position.

12. The connector of claim 11, wherein each said holder comprises locking means for lock engagement with a portion of the respective inner tubular body adjacent the rear end of the respective inner tubular body.

* * * * *